United States Patent [19]

Proctor

[11] 4,156,242

[45] May 22, 1979

[54] LIGHT-WEIGHT LOW-COST ANTENNA ELEMENT

[75] Inventor: David Proctor, San Diego, Calif.

[73] Assignee: The United States of America as represented by the Secretary of the Navy, Washington, D.C.

[21] Appl. No.: 585,142

[22] Filed: Jun. 9, 1975

[51] Int. Cl.[2] ..... H01Q 13/02

[52] U.S. Cl. ..... 343/776; 343/786

[58] Field of Search ..... 343/771, 789, 846, 872, 343/873, 776, 786; 333/21 R, 84 M

[56] References Cited

U.S. PATENT DOCUMENTS

| | | | |
|---|---|---|---|
| 2,877,429 | 3/1959 | Sommers et al. | 333/84 M |
| 2,914,766 | 11/1959 | Butler | 343/771 |
| 2,938,175 | 5/1960 | Sommers et al. | 333/84 M |
| 3,303,439 | 2/1967 | Fulp | 333/84 M |
| 3,518,683 | 6/1970 | Jones | 343/873 |
| 3,653,052 | 3/1972 | Campbell et al. | 343/771 |

*Primary Examiner*—David C. Nelms

*Attorney, Agent, or Firm*—R. S. Sciascia; G. J. Rubens; H. Fendelman

[57] ABSTRACT

An antenna array comprising a plurality of antenna elements formed from metal-clad boards and conductive pins. Two metal-clad boards are placed together to form a sandwich, the metal-clad surfaces of the boards forming the top and bottom walls of a waveguide. Pins are placed perpendicular to the clad surfaces to form the sidewalls. The signal is introduced by a coaxial probe in the broad wall of the waveguide in a conventional manner. A row of pins defines the backwall of the waveguide.

1 Claim, 6 Drawing Figures

LIGHT-WEIGHT LOW-COST ANTENNA ELEMENT

BACKGROUND OF THE INVENTION

The present invention relates to the field of microwave antennas which are comprised of waveguide elements. Slots are widely employed as elements in scanning antenna arrays. Many large scanning antennas are composed of a two-dimensional array of rectangular slots, in which each slot is fed by a separate waveguide. These devices, however, require a different size slot and waveguide for each frequency band. Moreover, rows of antenna elements made of hollow waveguides are difficult to stack due to space requirements.

SUMMARY OF THE INVENTION

The present invention relates to a light-weight, low-cost antenna array which can be constructed by using copper clad dielectric boards of the type generally used for stripline. Since these boards are very thin, as compared with rectangular waveguides, an array combining groups of antenna elements at several frequency bands can be interlaced to provide a multi-frequency, multi-function antenna in a common space. Additionally, only one size board needs to be used in the present invention for several frequency bands, whereas in hollow waveguide, as stated above, a different size must be used for each frequency band. A corporate feed can be built integral with the same dielectric board, thus further reducing the size and weight of the array.

STATEMENT OF THE OBJECTS OF THE INVENTION

It is the primary object of the present invention to disclose a novel antenna element.

It is a further object of the present invention to disclose a novel antenna array.

It is a still further object of the present invention to disclose a novel antenna element and array which is a low cost, light weight, and reduced size substitute for a hollow waveguide antenna element and array.

Other objects, advantages and novel features of the invention will become apparent from the following detailed description of the invention when considered in conjunction with the accompanying drawings.

DESCRIPTION OF THE PREFERRED EMBODIMENTS

Figure 2:
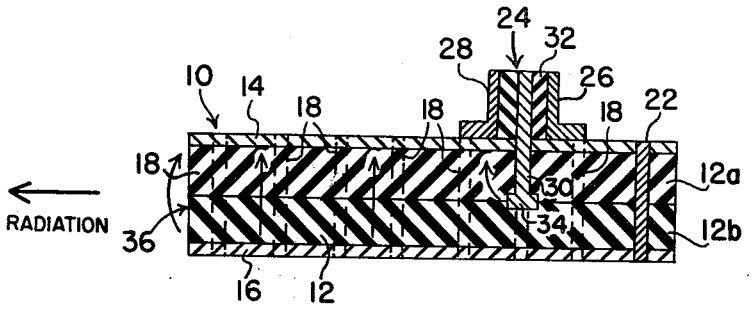
FIG. 2 is a side view of the antenna element of FIG. 1 taken along lines 2—2.
Figure 1:
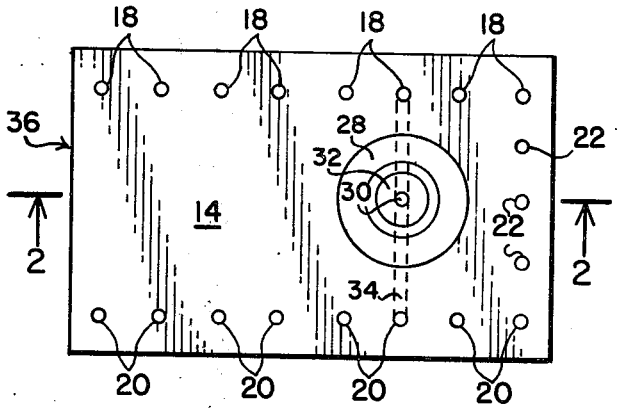
FIG. 1 is a plan view of an antenna element according to the present invention.
Figure 3:
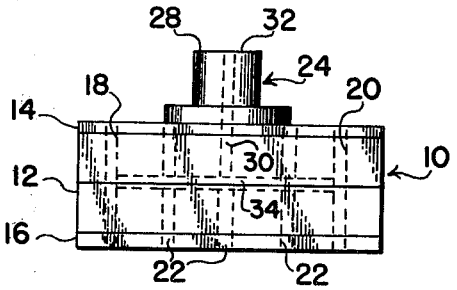
FIG. 3 is a front end view of the device illustrated in FIG. 1.

The antenna element of the present invention is illustrated in FIGS. 1, 2, and 3. The element comprises a dielectric layer 12 which may be, for example, PTFE fluorocarbon and for ease of manufacture preferably consists of two separate dielectric sheets 12*a* and 12*b*, each separate sheet being bonded on one side by suitable metal sheets 14 and 16 which may, for example, be copper. Each of the conductive pins 18, 20, and 22 are normal to and extend between the top copper surface 14 and the bottom copper surface 16 and are in electrical contact therewith. The conductive pins 18, 20, and 22 may be metallic screws or rivets, for example, and must be placed sufficiently close together to prevent radiation therebetween. It is noted, however, that by properly separating a pair of conducting members 18, 20, or 22, a sidewall or backwall radiating slot could be provided (not shown). The pins 18, therefore, form a first row of conductive elements which is parallel to the row of conductive elements formed by pins 20 and the pins 22 form a third row of conductive elements normal to the rows formed by pins 18 and 20. Top and bottom metal surfaces 14 and 16, therefore, define the top and bottom walls of a dielectric filled waveguide, the rows formed by pins 18 and 20 define the sidewalls of the waveguide and the row formed by pins 22 defines the backwall of the waveguide. The dimension between the rows formed by pins 18 and 20 is selected for the frequency band desired and is equal to one half the wavelength below which no propagation can occur.

Energy is injected into the waveguide antenna element 10 through mode launcher 24 which comprises a coaxial fitting 26 having outer conductor 28 in electrical contact with the metallic sheet 14 and inner conductor 30 separated by insulator 32 from the outer conductor 28. A conductive strip 34 is placed midway between and parallel to the conductive surfaces 14 and 16 and is electrically connected to inner conductor 30 and to pins 18 and 20. The conductive strip 34 is placed at a distance equal to $\lambda/4$ away from the backwall formed by pins 22, where $\lambda$ is the operating wavelength within the dielectric 12 at the midband of the device operating frequency. The E field is represented by the arrows in FIG. 2 and the radiation is out of the unbounded end 36 which functions as the antenna element.

Figure 4:
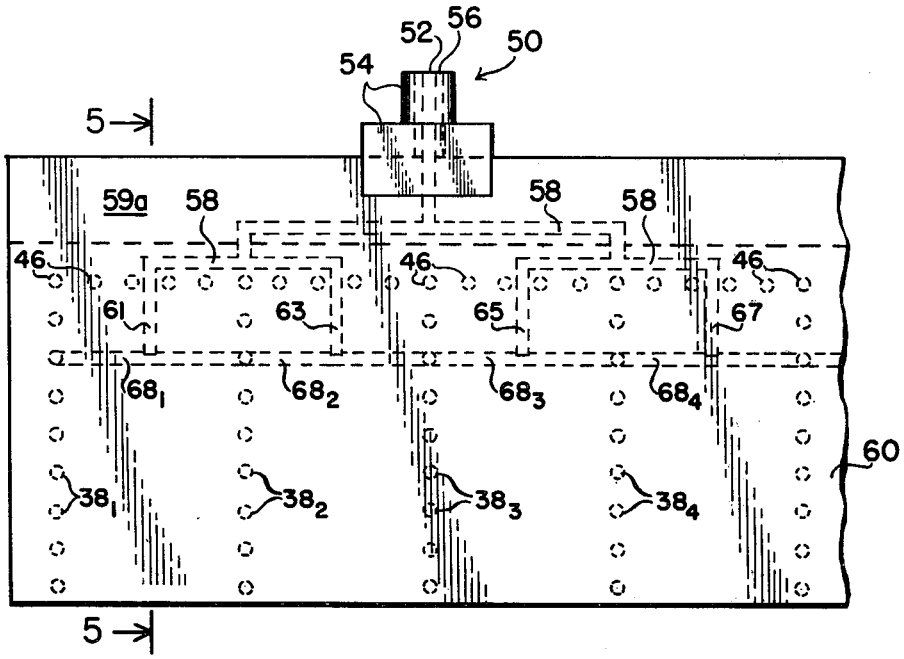
FIG. 4 is a plan view of a row of antenna elements according to the present invention including a corporate feed arrangement permitting easy stacking of rows of antenna elements.
Figure 5:
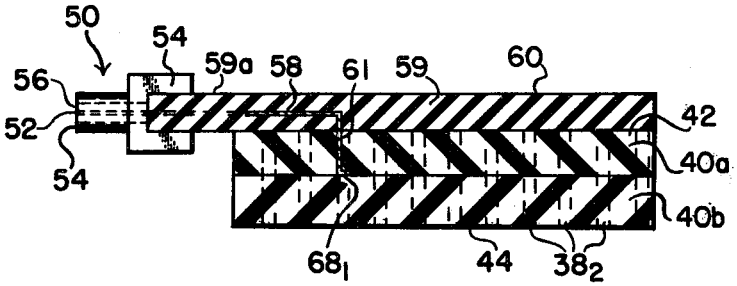
FIG. 5 is an end view of the device illustrated in FIG. 4 taken along section 5—5.
Figure 6:
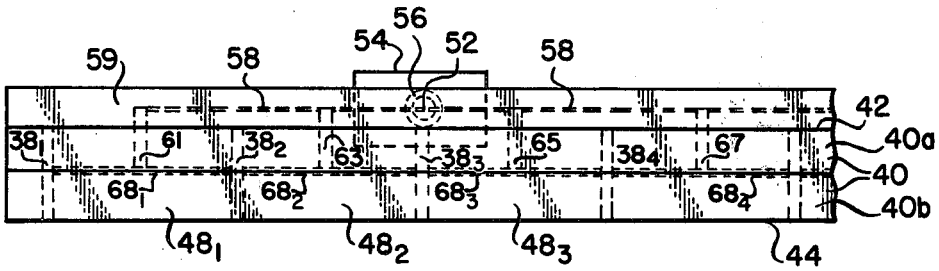
FIG. 6 is a front end view of the device of FIG. 4.

A single dielectric sheet can be used to construct a row of the antenna elements described above and a corporate feed may be provided in another dielectric sheet for feeding the antenna elements as is illustrated in FIGS. 4, 5, and 6. As is seen in FIGS. 4, 5, and 6, a plurality of parallel rows of conductive members $38_1$, $38_2$, $38_3$, $38_4$, . . . is provided on a dielectric sheet 40 which is bonded with metal surfaces 42 and 44 as in the single antenna element 10 described above. Similarly, for ease of construction the dielectric 40 could be comprised of two separate sheets of dielectric 40*a* and 40*b*. The conductive members $38_1$, $38_2$, $38_3$, $38_4$, . . . , form the sidewalls of a plurality of adjacent waveguides, the backwall of the waveguides being formed by the row of conductive members 46. It is noted that a single row of conductive members, e.g., $38_2$, forms the waveguide wall for two separate waveguides and that due to the fact that each of the antenna elements $48_1$, $48_2$, $48_3$, $48_4$, . . . is constructed on the same dielectric sheet there is no construction problem in physically attaching the waveguide antenna elements together, as is the case with hollow waveguides.

A distinct advantage of the present invention is its adaptability for inclusion of a corporate feed structure illustrated in FIGS. 4, 5, and 6. A coaxial input 50 may be provided including inner conductor 52 separated from outer conductor 54 by insulator 56 as is well known. The inner conductor 52 of coaxial connector 50 is extended to electrically join feed line 58 which is disposed within solid dielectric 59. The dielectric 59 is provided with a metal clad upper surface 60 and is secured to the metal surface 42 by suitable means. Feed line 58 is illustrated as branching into feed lines 61, 63, 65, and 67 for feeding a multiple of four antenna elements. Each of the feed line branches 61, 63, 65, 67, etc., extends vertically through dielectric 59 and dielectric 40 as illustrated in FIG. 5 and is coupled to its respective center conductive strip $68_1$, $68_2$, $68_3$, $68_4$, . . . for injecting the signal into the guide. It should be observed that the dielectric 59 and metal surface 60 are extended at section 59*a* and that the coaxial input is connected at the end of the extended section. This permits stacking of a plurality of rows of antenna elements whereby several rows can be combined to form a two dimensional or planar array that is free from constructional spacing problems since the coaxial fittings for the lower rows of elements will fit in the space under section 59*a*. Additionally, similar rows of antenna elements operating at different frequency bands can be interlaced into a common antenna.

The present invention thus provides a practical solution to the problem of development of an integrated antenna system. The antenna element and array of the present invention results in greatly reduced size, weight, and cost as compared to similar antenna arrays constructed in hollow waveguides.

Obviously many modifications and variations of the present invention are possible in the light of the above teachings. It is therefore to be understood that within the scope of the appended claims the invention may be practiced otherwise than as specifically described.

What is claimed is:

1. An antenna array comprising:

a first dielectric sheet having a top surface, a bottom surface, and an end surface;

first and second conductive surfaces disposed on said top and bottom surfaces, respectively;

a plurality of adjacent antenna elements formed in said dielectric sheet, each said antenna element comprising a waveguide including a first linear arrangement of a first plurality of conductive members, each conductive member interconnecting said first and second conductive surfaces and a second linear arrangement of a second plurality of conductive members, each conductive member interconnecting said first and second conductive surfaces, each said second linear arrangement being a common waveguide wall for adjacent antenna elements;

a third linear arrangement of a third plurality of conductive members each interconnecting said top and bottom surfaces, said third linear arrangement being normal to and extending between each said first and second linear arrangement of each of said plurality of antenna elements;

a second dielectric sheet disposed on said first conductive surface;

a third conductive surface disposed on said second dielectric sheet; and a conductive feed means disposed within said second dielectric sheet for transmitting energy to each of said antenna elements.

* * * * *